US008936502B2

(12) United States Patent
King et al.

(10) Patent No.: US 8,936,502 B2
(45) Date of Patent: Jan. 20, 2015

(54) SENSORY WALL SYSTEMS

(75) Inventors: Steven G. King, Maple Plain, MN (US); Thomas L. Keller, Delano, MN (US)

(73) Assignee: Landscape Structures Inc., Delano, MN (US)

( * ) Notice: Subject to any disclaimer, the term of this patent is extended or adjusted under 35 U.S.C. 154(b) by 149 days.

(21) Appl. No.: 13/309,055

(22) Filed: Dec. 1, 2011

(65) Prior Publication Data

US 2012/0142441 A1 Jun. 7, 2012

Related U.S. Application Data

(60) Provisional application No. 61/418,442, filed on Dec. 1, 2010.

(51) Int. Cl.
*A63H 33/00* (2006.01)

(52) U.S. Cl.
USPC ..... 446/227; 446/408; 446/418

(58) Field of Classification Search
USPC ..... 273/241, 285, 287; 446/80, 227, 478, 446/487, 491, 404, 408, 418
See application file for complete search history.

(56) References Cited

U.S. PATENT DOCUMENTS

| | | | | | |
|---|---|---|---|---|---|
| 243,873 | A | * | 7/1881 | Crandall | 446/75 |
| 1,317,880 | A | * | 10/1919 | Lyman | 273/287 |
| 1,619,683 | A | * | 3/1927 | Stinson | 84/472 |
| 2,474,447 | A | * | 6/1949 | Wheelock | 434/172 |
| 2,717,156 | A | * | 9/1955 | Nelson | 273/248 |
| 3,316,669 | A | * | 5/1967 | Nachbar | 40/620 |
| 3,414,987 | A | * | 12/1968 | Lindenauer | 434/429 |
| 3,592,289 | A | * | 7/1971 | Aysta et al. | 160/135 |
| 3,629,960 | A | * | 12/1971 | Roush | 434/429 |
| 4,111,418 | A | * | 9/1978 | DeMent, Jr. | 273/440 |
| 4,342,173 | A | * | 8/1982 | Otake | 446/472 |
| 4,345,902 | A | * | 8/1982 | Hengel | 434/170 |
| 4,545,768 | A | * | 10/1985 | Hinnen | 434/304 |
| 4,600,399 | A | * | 7/1986 | Abe | 446/242 |
| 4,696,652 | A | * | 9/1987 | Reeder et al. | 446/75 |
| 4,772,027 | A | * | 9/1988 | Martel et al. | 273/237 |
| 4,935,976 | A | * | 6/1990 | Milman | 5/93.1 |
| 5,429,432 | A | * | 7/1995 | Johnson | 312/235.3 |
| 5,544,870 | A | * | 8/1996 | Kelley et al. | 256/26 |
| 5,801,320 | A | * | 9/1998 | Segan et al. | 84/738 |
| 5,961,149 | A | * | 10/1999 | Hunt | 281/22 |
| 6,066,022 | A | * | 5/2000 | Fobean et al. | 446/227 |
| 6,113,454 | A | * | 9/2000 | Mitchell | 446/227 |
| 6,565,413 | B2 | * | 5/2003 | Brownrigg | 446/476 |
| 6,581,931 | B1 | * | 6/2003 | Doepner et al. | 273/118 A |
| 6,967,831 | B2 | * | 11/2005 | Chuang | 361/679.15 |
| 7,040,899 | B2 | * | 5/2006 | Armstrong | 434/430 |
| 7,333,321 | B2 | * | 2/2008 | Sutton et al. | 361/679.09 |
| 7,694,364 | B1 | * | 4/2010 | Toma | 5/424 |
| 7,813,116 | B2 | * | 10/2010 | Hsu | 361/679.33 |
| 8,070,552 | B2 | * | 12/2011 | Snyder | 446/227 |
| 2003/0071496 | A1 | * | 4/2003 | Bellows et al. | 297/137 |

* cited by examiner

*Primary Examiner* — Vishu K. Mendiratta
(74) *Attorney, Agent, or Firm* — Christopher L. Holt; Kelly, Holt & Christenson, PLLC

(57) ABSTRACT

Sensory wall systems are provided. In one embodiment, a sensory wall system includes one or more middle sections, one or more end sections, and an insert panel. The one or more middle sections have sides that are configurable to be attached to other middle sections or to the end sections. The one or more end sections are connected to the one or more middle sections. The insert panel is within the one or more middle sections and includes an activity for a child.

19 Claims, 5 Drawing Sheets

SENSORY WALL SYSTEMS

REFERENCE TO RELATED CASE

The present application is a non-provisional application that is based on and claims the priority of provisional application Ser. No. 61/418,442, filed on Dec. 1, 2010, the contents of which are hereby incorporated by reference in their entirety.

BACKGROUND

Children with autism and/or sensory processing disorders may find challenges with socialization, communication, play, and imagination. Little attention has been devoted to addressing this issue on the playground. Therefore, it would be beneficial to have playground equipment that is welcoming to all children including those with autism and/or other sensory processing disorders.

SUMMARY

An aspect of the disclosure relates to sensory wall systems. In one embodiment, a sensory wall system includes one or more middle sections, one or more end sections, and an insert panel. The one or more middle sections have sides that are configurable to be attached to other middle sections or to the end sections. The one or more end sections are connected to the one or more middle sections. The insert panel is within the one or more middle sections and includes an activity for a child.

These and various other features and advantages that characterize the claimed embodiments will become apparent upon reading the following detailed description and upon reviewing the associated drawings.

BRIEF DESCRIPTION OF THE DRAWINGS

FIGS. 2-1 through 2-7 are perspective views of different insert panels that can be used with a sensory wall system.

FIG. 3 is a perspective view of a sensory wall system with two insert panels.

FIG. 4 is perspective view of a sensory wall system with multiple insert panels.

DETAILED DESCRIPTION

While it has long been recognized that children on the autism spectrum often have difficulty playing and socializing like typically-developing children, little attention has been devoted to addressing this issue on the playground. Embodiments of the present disclosure address the issue and provide environments for meeting the play and socialization needs of all children, in particular those on the autism spectrum.

Sensory wall components attract children and encourage exploration and discovery, and provide a "just-right" experience for those seeking sensory stimulation. With its inclusive play solution, sensory wall components address the sensory needs of all children and welcome those with autism and other sensory processing disorders into the play environment. Additionally, at least certain embodiments illustratively provide rich tactile, proprioceptive, vestibular, visual and auditory experiences, as well as help develop motor-planning skills and increase social/imaginative play opportunities.

Sensory wall components are designed to bring children of all abilities together in close proximity to encourage parallel and cooperative play. In one embodiment, sensory wall components include a configurable system with multiple highly-interactive play activities using marbles, gears, mazes, kaleidoscopes, and more. Additionally, the custom wall that supports the interactive activities provides a one-of-a-kind artfully designed sensory centerpiece to any inclusive playground and can be designed to match the theme of any environment.

Figure 1:
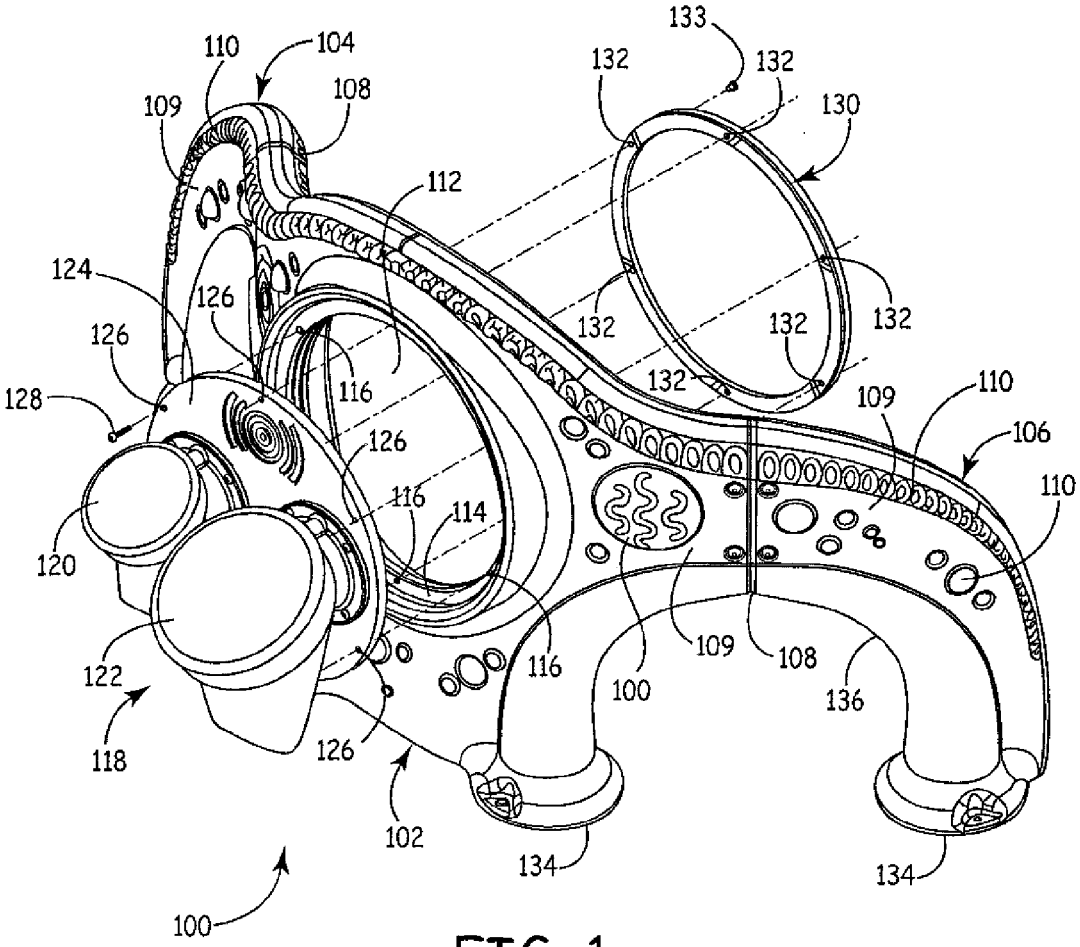
FIG. 1 is a perspective view of a sensory wall system with a bongo insert panel.

FIG. 1 shows one embodiment of a sensory wall system 100. System 100 illustratively includes a middle wall section 102, a first side section 104, and a second side section 106. The side sections 104/106 are optionally connected to middle section 102 at joints 108. In one embodiment, joints 108 are moveable such that side sections 104/106 can be pivoted/rotated relative to the middle section 102. In another embodiment, joints 108 are fixed position such that the side sections 104/106 are stationary in one position relative to middle section 102.

As is shown in FIG. 1, the outer surfaces 109 of the wall sections 102, 104, and 106 optionally include a number of sensory stimulating features 110 (e.g. textured features). Features 110 may also illustrative enhance an aesthetic appearance of the sensory wall system. Any combination of different types of features 110 can be placed on the outer surface of the wall.

Middle wall section 102 illustratively includes an aperture 112 and a ridge 114 that surrounds the aperture 112. The ridge 114 optionally has a number of apertures 116 (three are numbered in FIG. 1, but embodiments can include any number of apertures 116).

Sensory wall system 100 also optionally includes one or more insert panels 118. In the particular example shown in FIG. 1, insert panel 118 is a drum/bongos insert panel that includes a small bongo 120 and a large bongo 122. Bongos 120 and 122 are illustratively mounted to a support panel 124 that may include one or more apertures 126 (three are labeled in FIG. 1, but embodiments can include any number of apertures 126). Panel 118 may provide resonant tones, providing deep auditory stimulation.

In an embodiment, insert panel 118 is attached to middle wall section 102 by placing support panel 124 against ridge 114. Then, attachment mechanisms 128 (e.g. screws, bolts, etc.) are put through the support panel apertures 126 and the ridge apertures 116. Additionally, in at least some embodiments, system 100 includes a support ring 130 having apertures 132. Support ring 130 is illustratively placed on the opposite side of ridge 114 from the insert panel 118, and the attachment mechanism also go through the support ring apertures 132 to secure the insert panel 118 in place on the middle wall section 102. Securing mechanisms 133 (e.g. bolts, nuts, etc.) are illustratively secured to attachment mechanisms 128 to hold everything in place. It should be noted that insert panel 118 can be attached to middle wall section 102 in the opposite direction such that the bongos are accessible from the other side of the wall. It should also be noted that other attachment methods can be used to attach insert panel 118 to middle wall section 102 and that embodiments are not limited to the specific example that is given for illustration purposes only.

System 100 also optionally includes mounting feet 134. In an embodiment, middle wall section 102 has two feet 134 and each side section 104/106 has one foot 134. Feet 134 illustratively enable the wall to be set in an upright fashion. The feet 134 may simply set on a surface (e.g. the ground), or can be attached to underground assemblies (e.g. a concrete footing) to provide a more permanent installation. System 100 may also include an opening formed by an arch 136 between the side sections 104/106 and middle section 102. The opening can provide an opportunity for children to crawl through the opening to reach the other side.

FIGS. 2-1 through 2-7 illustrate some examples of other embodiments of insert panels that can be used with a sensory wall system. For example, each of the insert panels in FIGS. 2-1 through 2-7 can be attached to middle section 104 in the same or similar way as insert panel 118 is shown as being attached to section 104 in FIG. 1 (e.g. using attachment mechanisms and apertures). In certain embodiments, a sensory wall system 100 includes multiple insert panels such that different play environments can be provided by switching the insert panel being used. Additionally, as will become more clear below, the different insert panels may provide different sensory/play experiences.

Figures 1, 2:
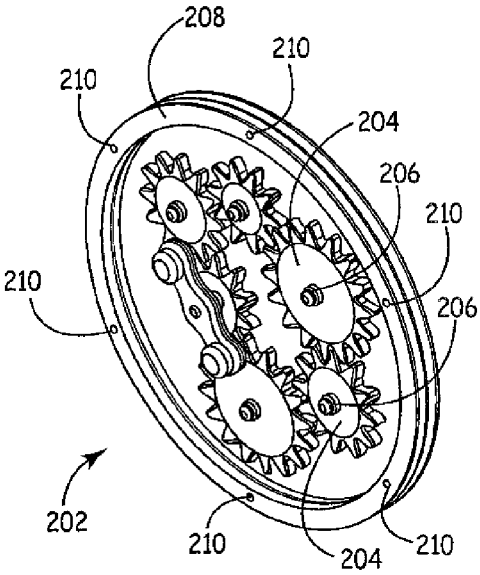
Figure 2:
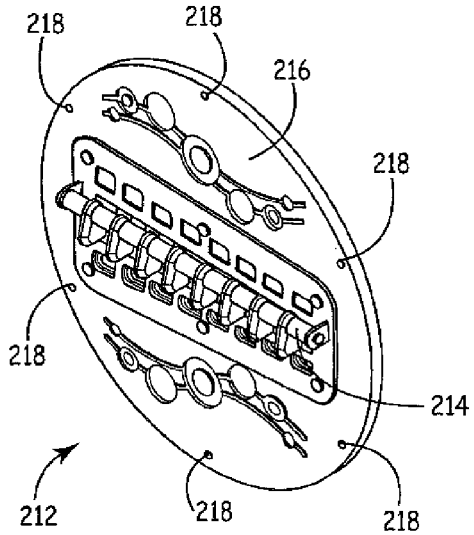

FIG. 2-1 shows one example of an insert panel 202. Panel 202 illustratively includes one or more rotatable members 204 (e.g. gear, sprocket, wheel, etc.) that are attached to support panel 208 through an axis of rotation 206. Support panel 208 may also have apertures 210 for securing panel 202 to a wall section (e.g. using screws and bolts). Panel 202 illustratively helps develop upper-body strength and dexterity, and provides tactile and visual sensory input.

FIG. 2-2 shows one example of an insert panel 212. Panel 212 illustratively includes a musical instrument 214. In one embodiment, the instrument 214 is a percussion instrument such as, but not limited to a xylophone or a glockenspiel that enables a user to make a sound by striking the surfaces of the keys. Panel 212 may also include a support panel 216 having apertures 218. Panel 212 may promote auditory stimulation and shared play.

Figures 2, 3:
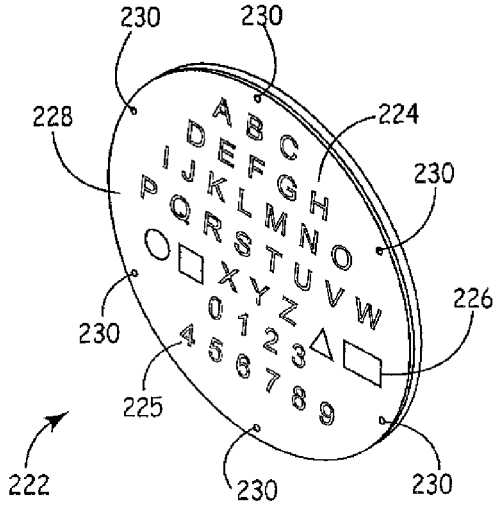

FIG. 2-3 shows one example of an insert panel 222. Panel 222 illustratively includes a number of letters 224 (e.g. the entire alphabet), numbers 225 (e.g. 0-9), and shapes 226 (e.g. circle, square, triangle, rectangle). The letters 224, numbers 225, and shapes 226 can be cut out from support panel 228 (e.g. formed by apertures/holes) or can be printed for example on support panel 228. Panel 222 may encourage eye-hand coordination, tactile fun, and learning.

Figures 2, 3, 4:
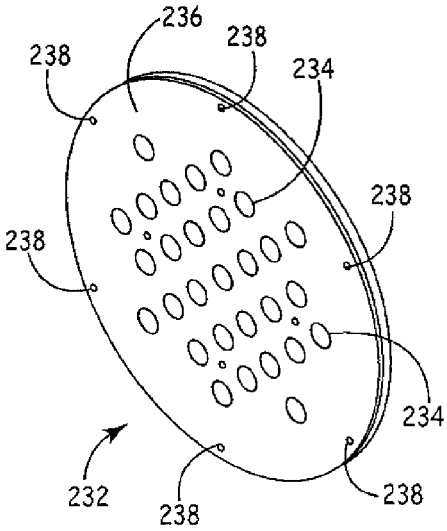
Figures 2, 3, 4, 5:
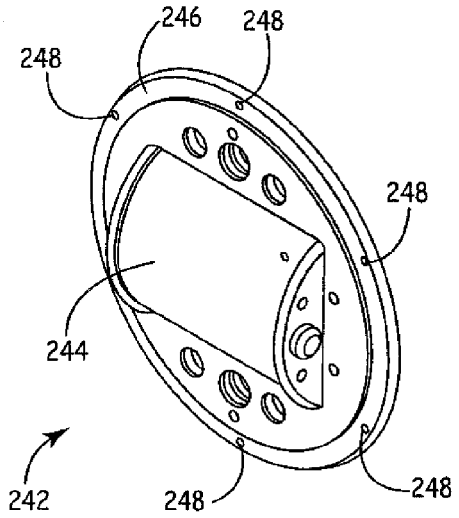
Figures 2, 3, 4, 5, 6:
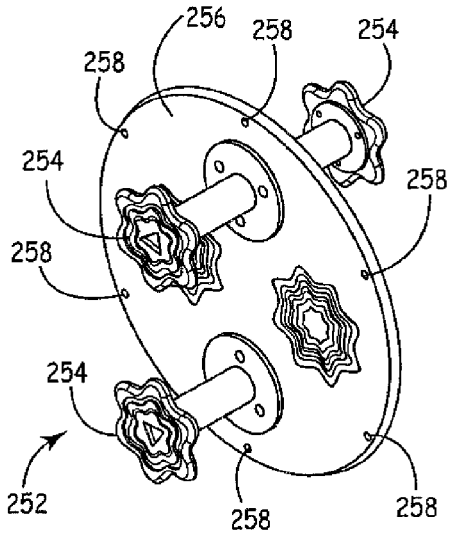
Figures 2, 3, 4, 5, 6, 7:
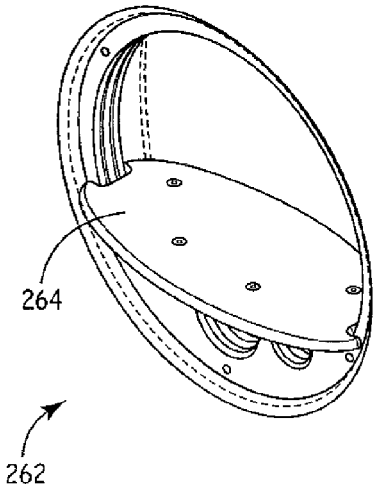
Figure 3:
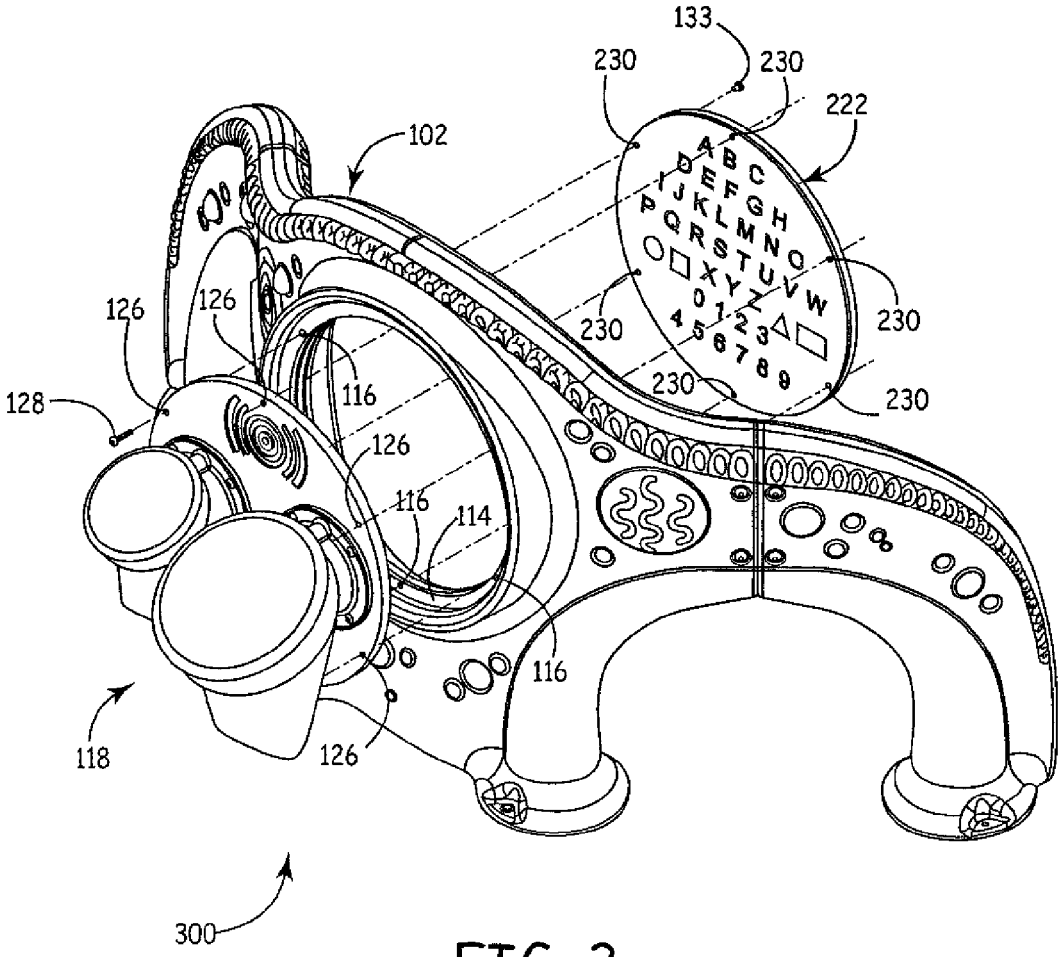
Figure 4:
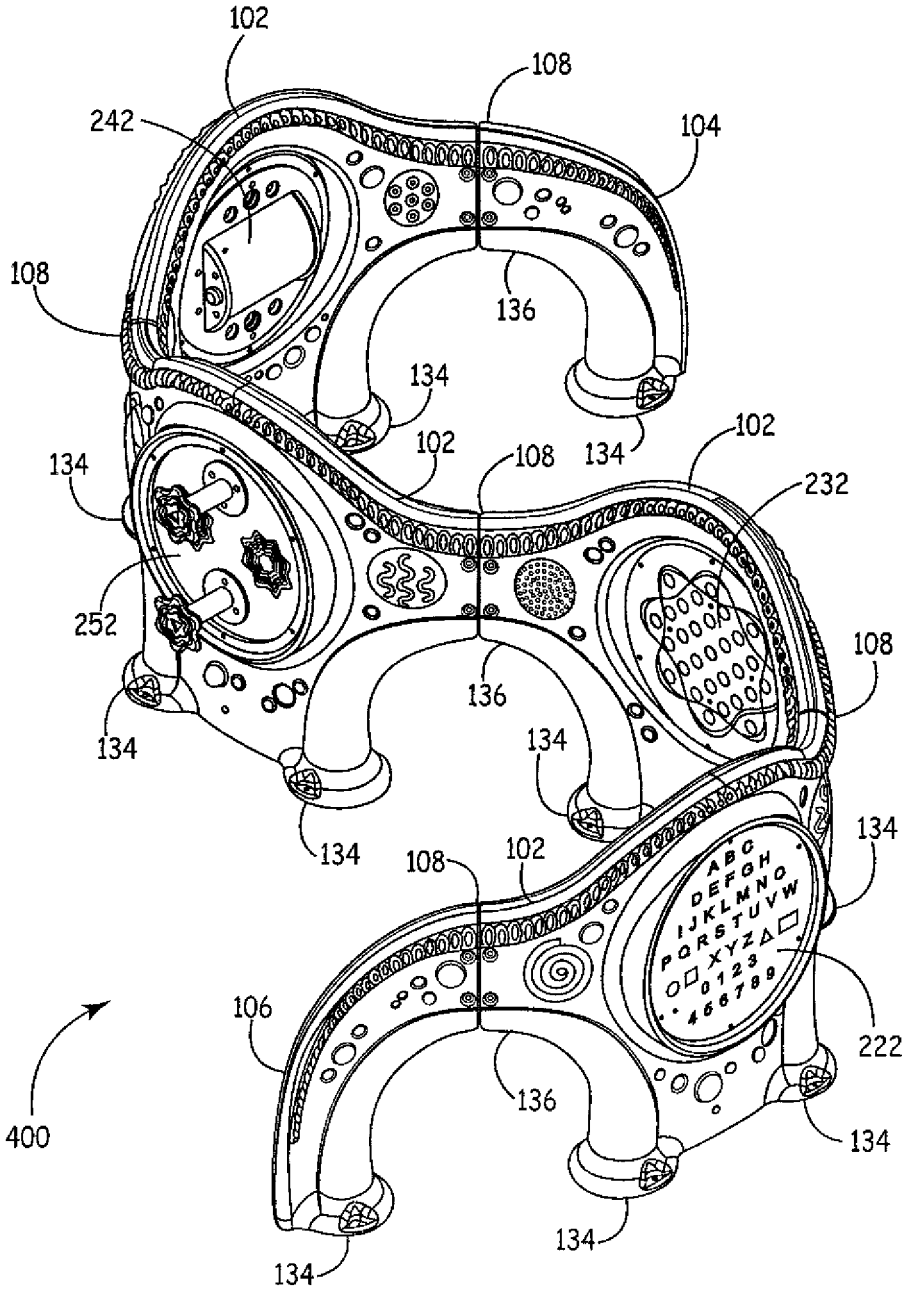

FIG. 2-4 shows one example of an insert panel 232. Panel 232 illustratively includes a number of marbles 234 that can either be rotatable or stationary. The marbles 234 are supported by a support panel 236 that includes apertures 238. Panel 232 may offer a sensory-rich visual and tactile experience.

FIG. 2-5 shows one example of an insert panel 242. Panel 242 illustratively includes a mirror assembly 244. Assembly 242 optionally includes a 2-sided concave/convex mirror that encourages peripheral vision and visual tracking. Similar to the other embodiments of insert panels, panel 242 also includes a support panel 246 and apertures 248.

FIG. 2-6 shows one example of an insert panel 252. Panel 252 illustratively includes one or more rotating visual mechanisms 254 (e.g. rotatable prisms and/or kaleidoscopes). As is shown in the figure, each side of support panel 256 illustratively includes one or more visual mechanisms 254 and apertures 258. Panel 252 may offer rich visual stimulation.

FIG. 2-7 shows one example of an insert panel 262. Panel 262 illustratively includes a surface 264 (e.g. a flat table surface) that is mounted horizontally within an aperture 112 (shown and labeled in FIG. 1). Panel 262 may enhance social development and creativity.

FIG. 3 shows an illustrative embodiment of a sensory wall system 300. As shown in the figure, any two insert panels (e.g. panels 118, 202, 212, 222, 232, 242, 252, 262) can be attached/mounted to/within a center wall section 102. For example, in FIG. 3, panel 118 is placed on one side of ridge 114, and panel 222 is placed on the other side of ridge 114. Then attachment mechanisms 128 are placed through apertures 126, 116, and 230, and are secured in place utilizing securing mechanisms 133. As previously mentioned, any other connection/attachment methods can be used and the method shown in the figure is given for illustration purposes only. Accordingly, one sensory wall system 300, or 100 in FIG. 1, can utilize multiple insert panels at the same time to provide additional play and learning opportunities.

FIG. 4 shows an illustrative embodiment of a sensory wall system 400. As can be seen in the figure, embodiments are illustratively modular in nature, and different combinations and numbers of components can be put together to form a sensory wall system. For instance, in the particular example shown in FIG. 4, the system 400 includes four different middle wall sections 102. The sections 102 are connected together and to end sections 104 and 106 at joints 108. In one embodiment, an arch or opening 136 is formed between/by the connection of two adjacent wall sections. Although four sections 102 are shown in FIG. 4, embodiments are not limited to any number of sections 102 and can include any number (e.g. 1, 2, 3, 4, 5, 6, etc.). Also, the positioning of each of the segments relative to each other can be adjusted by rotating the pieces about joints 108.

In the particular example shown in FIG. 4, four different insert panels 242, 252, 232, and 222 are included within sensory wall system 400. As illustrated in FIG. 3, insert panels can be mounted back-to-back such that system 400 could include up to eight different insert panels. Embodiments are configurable to include any number of insert panels, and thus can provide a wide variety of play and learning environments. FIG. 3 also shows system 400 including a number of feet 134 that as previously mentioned, can be mounted on top of a surface (e.g. ground) or be mounted underground (e.g. using an underground concrete footing).

Accordingly, each of the insert panels and/or wall sections alone and in combination provides a wide variety of play and learning experiences that may be suitable children with autism and/or sensory processing disorders. Additionally, the modular nature of the insert panels and wall sections enables the system to be changed relatively easily to provide new environments. It should be also noted that systems may be sold essentially as kits that include any one or more of the components described above or shown in the figures, such that a user can assemble a variety of different play environments.

Finally, it is to be understood that even though numerous characteristics and advantages of various embodiments have been set forth in the foregoing description, together with details of the structure and function of various embodiments, this detailed description is illustrative only, and changes may be made in detail, especially in matters of structure and arrangements of parts within the principles of the present disclosure to the full extent indicated by the broad general meaning of the terms in which the appended claims are expressed. In addition, although the embodiments described herein are directed to sensory wall systems, it will be appreciated by those skilled in the art that the teachings of the disclosure can be applied to other types of data storage systems, without departing from the scope and spirit of the disclosure.

What is claimed is:

1. A sensory wall system comprising:

one or more middle sections, the one or more middle sections having sides that are configurable to be connected to other middle sections or to end sections by joints, wherein the joints allow the one or more middle sections to rotate with respect to the other middle sections or end sections and further wherein the connection is configured such that the one or more middle sections stands perpendicular to the ground after connection;

one or more end sections connected to the one or more middle sections by joints, wherein the joints allow the one or more end sections to rotate with respect to the middle sections;

wherein each of the one or more middle sections has a first edge and a second edge, wherein the first edge runs parallel to the second edge, and wherein each of the one or more middle sections connects, on both the first edge and the second edge to either another middle section or another end section;

at least two insert panels within the one or more middle sections and one or more end sections, wherein a first insert panel comprises a first activity for a child and a second insert panel comprises a second activity for a child, and wherein the second activity presents a different activity to the child than the first activity, such that the child engages with the second insert panel in a different manner than the first insert panel; and wherein the insert panel includes one or more drums, wherein each of the one or more drums comprises a structure that extends permanently outward from the insert panel and provides a substantially round surface for drumming, wherein the surface fore drumming is angled away from the insert panel such that the angle created by the bottom of the substantially round surface for drumming and the insert panel comprises and acute angel.

2. The system of claim 1, and further comprising:

wherein the first insert panel and the second insert panel are mounted back-to-back within one of the one or more middle sections or one or more end sections such that the first activity is opposite the second activity.

3. The system of claim 2, wherein the insert panels mounted back-to-back both comprise the same activity.

4. The system of claim 1, wherein the insert panel includes a percussion instrument having a series of keys, wherein the percussion instrument generates a different auditory tone for each of the keys when struck.

5. The system of claim 1, wherein the insert panel includes numbers, letters, and shapes.

6. The system of claim 1, wherein the insert panel includes marbles.

7. The system of claim 1, wherein the insert panel includes a mirror assembly.

8. The system of claim 1, wherein the insert panel includes a kaleidoscope.

9. The system of claim 1, wherein the middle section further includes support panel apertures and ridge apertures for attaching the insert panel to the middle section.

10. The system of claim 1, and a third insert mounted within one of the middle sections or end sections, wherein the third insert comprises a third activity with texture configured to stimulate a visual sense and a tactile sense of a user.

11. A kit for creating a sensory wall system, the kit comprising:

a plurality of wall sections designed to stand perpendicularly to a mounting foot, wherein the wall section is configured to mount insert panels;

a set of exchangeable, semi-permanent insert panels, wherein each of the insert panels comprises a separate activity for a child, and wherein each activity is configured for the child to physically interact with, the set comprising:

a first insert panel that includes one or more drums, wherein each of the one or more drums comprises a structure that extends outward from the insert panel and provides a surface for drumming, wherein the surface for drumming is angled away from the insert panel;

a second insert panel that includes a percussion instrument having a series of keys, wherein the percussion instrument generates a different auditory tone for each of the keys when struck;

a third insert panel that includes numbers, letters, and shapes;

a fourth insert panel that includes marbles;

a fifth insert panel that includes a mirror assembly;

a sixth insert panel that includes a kaleidoscope;

a seventh insert panel that includes a table; and an eighth insert panel that includes rotatable members; and wherein each of the plurality wall sections is configured to engage with another one of the plurality of wall sections such that a first wall section is connected to a second wall section and wherein each of the first and second wall sections comprises an insert panel, and wherein the insert panel of the first wall section is different from the insert panel of the second wall section.

12. The kit of claim 11, wherein each of the insert panels includes a support panel having apertures for attaching the insert panel to the wall section.

13. The kit of claim 11, wherein the wall section includes a ridge having apertures for attaching the insert panels to the wall section.

14. The kit of claim 11, and further comprising:

one or more additional wall sections that are configured to be attached to the wall section and that are configured to mount the insert panels.

15. The kit of claim 11, and further comprising:

a support ring that is configured to be utilized in mounting the insert panels to the wall section.

16. A sensory wall system comprising:

one or more middle sections, the one or more middle sections having sides that are configurable to be connected to other middle sections or to end sections by joints, wherein the joints allow the one or more middle sections to rotate with respect to the other middle sections or end sections and further wherein the connection is configured such that the one or more middle sections stands perpendicular to the ground after connection;

one or more end sections connected to the one or more middle sections by joints, wherein the joints allow the one or more end sections to rotate with respect to the middle sections;

wherein each of the one or more middle sections has a first edge and a second edge, wherein the first edge runs parallel to the second edge, and wherein each of the one or more middle sections connects, on both the first edge and the second edge to either another middle section or another end section;

at least two insert panels within the one or more middle sections and one or more end sections, wherein a first insert panel comprises a first activity for a child and a second insert panel comprises a second activity for a child, and wherein the second activity presents a different activity to the child than the first activity, such that the child engages with the second insert panel in a different manner than the first insert panel; and wherein the insert panel includes a percussion instrument having a series of keys, wherein the percussion instrument generates a different auditory tone for each of the keys when struck.

17. The sensory wall system of claim 16, wherein the insert panel includes one or more drums, wherein each of the one or more drums comprises a structure the extends permanently outward from the insert panel and provides a substantially round surface for drumming, wherein the surface for drumming is angled away from the insert panel such that the angle created by the bottom of the substantially round surface for drumming and the insert panel comprises an acute angle.

18. The system of claim 16, and further comprising:

wherein the first insert panel and the second insert panel are mounted back-to-back within one of the one or more middle sections or one or more end sections such that the first activity is opposite the second activity.

19. The system of claim 16, wherein the insert panels mounted back-to-back both comprise the same activity.

* * * * *